US008121501B2

(12) United States Patent
Mashiba

(10) Patent No.: US 8,121,501 B2
(45) Date of Patent: Feb. 21, 2012

(54) IMAGE FORMING APPARATUS WITH COLOR DETECTION OF A REFERENCE TONER IMAGE AND SHEET

(75) Inventor: Tamaki Mashiba, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 709 days.

(21) Appl. No.: 12/170,682

(22) Filed: Jul. 10, 2008

(65) Prior Publication Data

US 2009/0016749 A1 Jan. 15, 2009

(30) Foreign Application Priority Data

Jul. 13, 2007 (JP) ..... 2007-184788

(51) Int. Cl.
*G03G 15/00* (2006.01)

(52) U.S. Cl. ..... 399/45; 399/72

(58) Field of Classification Search ..... 399/39, 399/41, 45, 49, 72, 74, 364, 389, 401, 302, 399/303

See application file for complete search history.

(56) References Cited

U.S. PATENT DOCUMENTS

| | | | | |
|---|---|---|---|---|
| 6,032,006 | A * | 2/2000 | Yanagida | 399/101 |
| 2005/0024654 | A1 | 2/2005 | Yamada | |
| 2005/0088710 | A1 | 4/2005 | Nakayama | |
| 2005/0151985 | A1 * | 7/2005 | Hisamura | 358/1.12 |
| 2006/0023272 | A1 | 2/2006 | Tezuka | |
| 2007/0091390 | A1 * | 4/2007 | Kimura et al. | 358/500 |
| 2007/0134010 | A1 * | 6/2007 | Yokoyama | 399/39 |
| 2008/0025742 | A1 * | 1/2008 | Kato et al. | 399/49 |

FOREIGN PATENT DOCUMENTS

| | | | |
|---|---|---|---|
| JP | 9-18729 | A | 1/1997 |
| JP | 10-272806 | A | 10/1998 |
| JP | 2003-15369 | A | 1/2003 |
| JP | 2003-219173 | A | 7/2003 |
| JP | 2004-109753 | A | 4/2004 |
| JP | 2005-43768 | A | 2/2005 |
| JP | 2005-103850 | A | 4/2005 |
| JP | 2005-125714 | A | 5/2005 |
| JP | 2006-42002 | A | 2/2006 |
| JP | 2007-148027 | A | 6/2007 |

OTHER PUBLICATIONS

English machine translation for JP-2007-148027-A, published Jun. 14, 2007.

* cited by examiner

*Primary Examiner* — David M. Gray
*Assistant Examiner* — Billy J Lactaoen
(74) *Attorney, Agent, or Firm* — Birch, Stewart, Kolasch & Birch, LLP

(57) ABSTRACT

In an image forming apparatus, the number of components and a size of the apparatus is reduced by realizing both functions for detecting a toner patch image to perform image quality adjustment and for performing precise color adjustment depending on a sheet color with one color sensor. The color sensor is disposed in a vicinity of a transport belt, a reference toner image is formed on the transport belt at a predetermined timing. A color of the reference toner image formed on the belt is detected by the color sensor to adjust development conditions. Further, the sheet is transported in a state where the transport belt is separated from a photoreceptor drum, and the sheet color is detected by the color sensor, and thereafter the transport belt touches the photoreceptor drum to transport the sheet to a transfer portion.

13 Claims, 14 Drawing Sheets

IMAGE FORMING APPARATUS WITH COLOR DETECTION OF A REFERENCE TONER IMAGE AND SHEET

CROSS-NOTING PARAGRAPH

This Non-provisional application claims priority under 35 U.S.C. §119(a) on Patent Application No. 2007-184788 filed in JAPAN on Jul. 13, 2007, the entire contents of which are hereby incorporated herein by reference.

FIELD OF THE INVENTION

The present invention relates to an electrophotographic image forming apparatus, for example, such as a copying machine, and more specifically relates to an image forming apparatus which performs adjustment to maintain quality of an image formed on an image carrier or a transfer sheet carrier using a patch image.

BACKGROUND OF THE INVENTION

An usual electrophotographic image forming apparatuses are susceptible to an usage state of each process portion, surrounding environmental situations and the like, due to the principle of operation that image formation is performed using static electricity and therefore, they have a problem that a toner density of a formed image is also liable to change and as a result, image quality is liable to deteriorate. Against these circumstances, in Japanese Laid-Open Patent Publication No. 2003-15369, an electrophotographic image forming apparatus is developed, in which an adjustment step of adjusting control conditions (charging voltage, exposure amount, developing bias, transfer bias and the like) in each portion of an image forming portion (process control) is provided and the adjustment step is carried out in accordance with predetermined conditions, and thereby image quality is adjusted so as to be able to obtain excellent image quality at all times.

In the above-mentioned image quality adjustment, a toner patch for a test is formed on an image carrier such as a photoreceptor, an intermediate transfer body or a transfer body at a predetermined timing other than forming images, and the above control conditions are adjusted based on the value of an image (toner) density of the toner patch measured by a density sensor.

In a process control mode, a toner patch serving as a density reference is formed on an image carrier (including an intermediate transfer body such as a photoreceptor, an intermediate transfer drum or an intermediate transfer belt, or a transfer body such as a transfer drum or a transfer belt), a density of the toner patch (toner adhesion amount) is detected by an image sensor that is an optical detection means, and based on the detected density, feedback is applied to parameters (image forming conditions), such as charging voltage, exposure intensity, developing bias potential, transfer voltage and amount of toner supply (in the case of two component development) which affect the image density.

On the other hand, Japanese Laid-Open Patent Publication No. 10-272806 discloses a technology that in a color image forming apparatus, a color sensor for detecting a sheet color is provided near a sheet supply port, and at the time of performing color printing, color tones of a sheet to be printed are detected by the color sensor, so that optimization of more precise color adjustment is applied depending on the color of the sheet to be printed.

However, in a color image forming apparatus provided with a function of detecting a toner patch image by a toner density sensor to perform image quality adjustment, a color sensor for detecting the sheet color needs to be further provided on a sheet transport path in order to add a function of applying optimization of color adjustment depending on a sheet color, but this inhibits miniaturization of the apparatus.

SUMMARY OF THE INVENTION

An object of the present invention is to provide a smaller image forming apparatus with smaller number of parts which is achieved by making a common color sensor detect a sheet color and a reference toner image not to further provide a color sensor for detecting the sheet color on a sheet transport path.

Another object of the present invention is to provide an image forming apparatus including an image carrier on which a toner image depending on input image data is formed, a transfer sheet carrier for forming a transfer sheet transport path and transferring the toner image formed on the image carrier onto a sheet being transported, a color sensor disposed in a vicinity of the transfer sheet transport path, a control portion for controlling an image forming operation, and an image adjustment function which performs an image adjustment using a reference toner image prior to printing when a color print mode is selected, wherein, a separation driving mechanism for separating the transfer sheet carrier from the image carrier and then contacting them and a sheet re-feeding transport path for feeding the sheet which has passed through the transfer sheet transport path again to the transfer sheet transport path are further included, and the control portion performs a series of control at the time of the image adjustment, to form the reference toner image on a surface of the transfer sheet carrier, to detect the reference toner image by the color sensor, to adjust developing conditions based on color information of the detected reference toner image, then, to transport the sheet on the transfer sheet transport path in a state where the transfer sheet carrier is separated from the image carrier by the separation driving mechanism, to detect colors of the sheet by the color sensor, and to correct a color tone of the input image data based on the detected color of the sheet.

Another object of the present invention is to provide the image forming apparatus, wherein the sheet re-feeding transport path is the path reversing the side of the sheet.

Another object of the present invention is to provide the image forming apparatus, wherein the control portion controls to pass the sheet transported at the time of the image adjustment through the reversing transport path twice in a state where the transfer sheet transport path is separated from the image carrier, and to transfer the toner image on the same surface as that of the sheet color has been detected.

Another object of the present invention is to provide an image forming apparatus including an image carrier on which a toner image depending on input image data is formed, a transfer sheet carrier for forming a transfer sheet transport path and transferring the toner image formed on the image carrier onto a sheet being transported, a color sensor disposed in a vicinity of the transfer sheet transport path, a control portion for controlling an image forming operation, and a function which performs an image adjustment using a reference toner image prior to a start of printing when a color print mode is selected, wherein the control portion controls at the time of the image adjustment, to form the reference toner image on the sheet transported to the transfer sheet transport path, to detect a color of the sheet and the reference toner image by the color sensor, and to adjust developing conditions based on the detected color of the sheet and color information of the reference toner image.

Another object of the present invention is to provide the image forming apparatus, wherein the control portion controls to discharge the sheet on which the reference toner image has been formed at the time of the image adjustment into a sheet discharge tray different from a sheet discharge tray generally used in printing.

Another object of the present invention is to provide the image forming apparatus, wherein the image adjustment is carried out at the time of the first sheet feeding after a sheet cassette has been changed.

Another object of the present invention is to provide the image forming apparatus, wherein the image adjustment is carried out at the time of the first sheet feeding after a sheet supplying has been performed.

Another object of the present invention is to provide the image forming apparatus, wherein when a sheet is fed from a specific sheet tray, the image adjustment is carried out for each sheet feeding.

Another object of the present invention is to provide the image forming apparatus further including an operation input portion and a storage device for storing a variety of information such as color correction information based on sheet color information detected by the color sensor, wherein when sheet type information indicating a relationship between a sheet feed source of a sheet and a type of the sheet is inputted from the operation input portion, the sheet type information is stored in the storage device, and the control portion carries out the image adjustment based on the sheet type information and the color correction information which are stored in the storage portion.

PREFERRED EMBODIMENTS OF THE INVENTION

Figure 1:
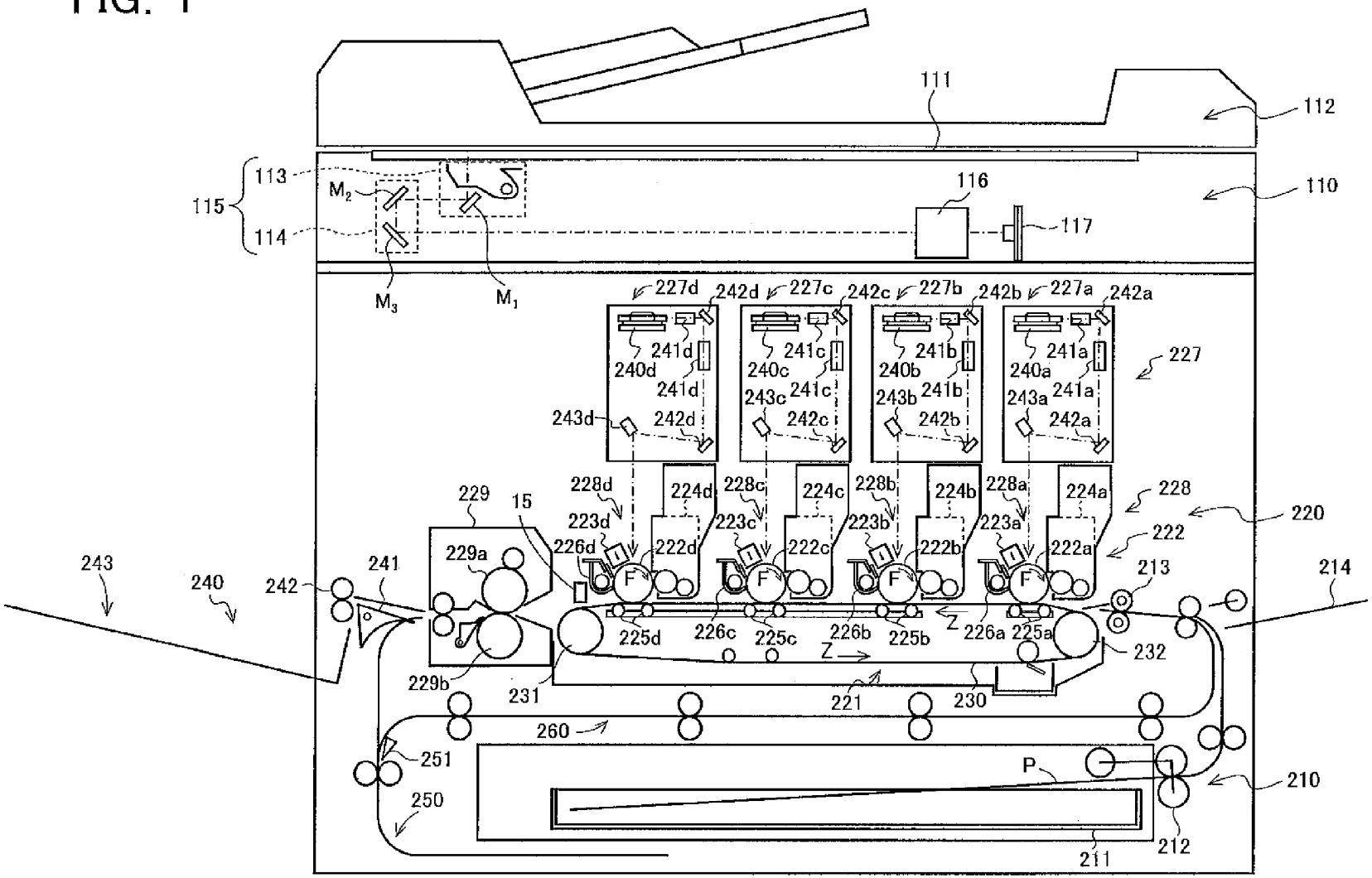
FIG. 1 is a sectional view schematically showing the structure of a digital color copying machine as an image forming apparatus to which the present invention is applied.

FIG. 1 is a sectional view schematically showing the structure of a digital color copying machine as an image forming apparatus to which the present invention is applied, and the digital color copying machine is provided with an image reading portion 110, a platen 111, a reversing automatic document feeder 112, a sheet feed portion 210, an image forming portion 220, and a sheet discharge portion 240.

The platen 111 is the glass plate on which originals for forming images are placed and is disposed on the upper side of a main body of the digital color copying machine. The reversing automatic document feeder (RADF) 112 transports documents to a predetermined position on the platen 111. The reversing automatic document feeder 112 is installed to be opened and shut like a cover for the platen 111 so as to come to the predetermined position facing the upper side of the platen 111.

The reversing automatic document feeder 112 transports a document first so that one side of the document faces the image reading portion 110 at a predetermined position of the platen 111, and after reading the image on this side is finished, the document is transported such that the other side faces the image reading portion 110 at a predetermined position of the platen 111. That is, the reversing automatic document feeder 112 transports the document so that an image or images on only one side or both sides of the document can be read, and after image reading for one document is completed, the document is discharged and the operation of reading and transporting is carried out on the following document. The transportation and the reversing operations are controlled according to an overall operation of the digital color copying machine.

The image reading portion 110 is disposed below the platen 111 to read an image in a document placed on the platen 111. The document is transported onto the platen 111 by the reversing automatic document feeder 112 or directly placed on the platen 111. The image reading portion 110 includes a document scanning body which moves to and fro in parallel along a lower side of the platen 111, an optical lens 116, and a CCD line sensor 17.

The document scanning body 115 is composed of a first scanning unit 113 and a second scanning unit 114. The first scanning unit 113 is provided with an exposure lamp for exposing the surface of an image in a document, and a first mirror $M_1$ for changing the course of a reflection image from the document in a predetermined direction. The first scanning unit 113 moves to and fro in parallel at a predetermined scanning speed with a fixed distance maintained from the lower surface of the platen 111. The second scanning unit 114 is provided with a second mirror $M_2$ and a third mirror $M_3$ for further changing the course of the reflection image from the document, that has been deflected by the first mirror $M_1$ of the first scanning unit 113, in a predetermined direction (the direction in which the optical lens 116 is disposed). The second scanning unit 114 moves to and fro in parallel with a fixed speed relative to the first scanning unit 113.

The optical lens 116 reduces the reflection image from the document, that has been deflected by the third mirror $M_3$ of the second scanning unit 114, and causes the reduced image to be formed on a light receiving surface on the COD line sensor 117. The CCD line sensor 117, which is an optical transducer, performs optical conversion to the light image formed by the optical lens 116 one after another to output electric signals The CCD line sensor 117 is preferably a so-called three-line color CCD which can read a monochrome image or a color image and output line data decomposed into each color component of R (red), G (green) and B (blue). The original image information converted into electric signals by the CCD line sensor 117 is further transferred to an image processing portion 41 shown in FIG. 2 and given the predetermined image data processing.

The sheet feed portion 210 is composed of a sheet tray 211, a sheet feed roller 212, a resist roller 213 and the like, and separates sheets (recording mediums) P which are stacked and stored in the sheet tray 211 one by one and supplies them to the image forming portion 220. The sheets P which have been separated and supplied one by one are transported to the image forming portion 220 with a timing being controlled by a pair of resist rollers 213 disposed between the sheet tray 211 and the image forming portion 220. In a so-called double-sided image formation mode in which images are formed on both sides of the sheet P, the sheet P is firstly transported to the image forming portion 220 and an image is formed on one side of the sheet P, subsequently the sheet P is reversed and transported again to the image forming portion 220, followed by forming an image on the other side.

In the above digital color copying machine, a cut sheet is used as the sheet P. When the sheet P is sent from the sheet tray 211 and supplied to a guide portion of a sheet feeding transport path of the sheet feed portion 210, the end of the sheet P is detected by a sensor (not shown). Then, based on a detection signal outputted from the sensor, the sheet P is temporarily stopped by the pair of resist rollers 213, and transported to the image forming portion 220 depending on a timing of the image formation. Note that, the sheet feeding can be also performed from a manual tray 214.

Figure 2:
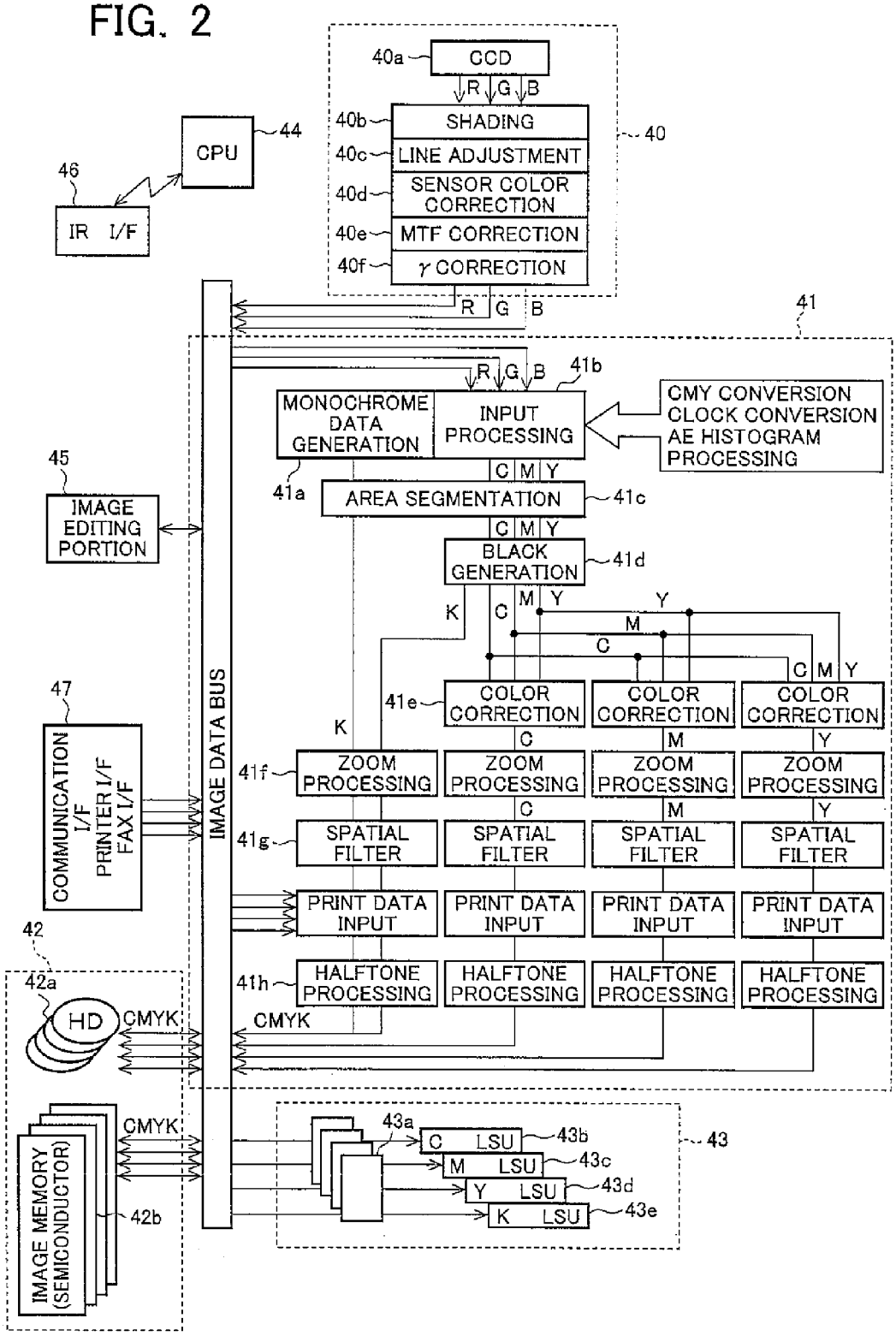
FIG. 2 is a block diagram of an image processing portion of the color digital copying machine.

The image forming portion 220 forms an image on the sheet P based on the image information of the document to which the image data processing is performed by the image processing portion 41 (refer to FIG. 2). The image forming portion 220 is provided with a transfer sheet transport belt mechanism 221, a laser writing unit 227, an image forming station 228, and a fixing device 229.

The transfer sheet transport belt mechanism 221 is provided with a drive roller 231, a driven roller 232, and a transfer sheet transport belt (transfer sheet carrier) 230 which is tensioned between the drive roller 231 and the driven roller 232 so as to extend almost in parallel. The transfer sheet transport belt 230 is frictionally driven in the direction indicated by an arrow Z according to the rotation of the drive roller 231. The sheet P fed through the sheet feed portion 210 is sent onto the transfer sheet transport belt 230 at the timing of forming images, and transported to the image forming station 228 in a state of being held by the transfer sheet transport belt 230 by electrostatic absorbing.

The image forming station 228 reproduces a toner image corresponding to image information of a document on the sheet P. The image forming station 228 is composed of a first image forming station 228*a* corresponding to a black component, a second image forming station 228*b* corresponding to a cyan component, a third image forming station 228*c* corresponding to a magenta component, and a fourth image forming station 228*d* corresponding to a yellow component. Each of the image forming stations 228*a* to 228*d* is disposed above the transfer sheet transport belt 230 so as to be close to the transfer sheet transport belt 230 in order from the upstream side of the sheet transport path.

The image forming stations 228*a* to 228 are substantially identical to one another in construction, hand respectively include photoreceptor drums 222*a* to 222*d* each of which is rotatively driven in the direction indicated by an arrow F. Around each of the photoreceptor drums 222*a* to 222*d*, charging devices 223*a* to 223*d* for electrifying each of the photoreceptor drums uniformly, developing devices 224*a* to 224*d* for developing electrostatic latent images respectively formed on the photoreceptor drums, transfer rollers 225*a* to 225*d* which function as transfer electrodes for transferring toner images, which have been developed on the photoreceptor drums, onto the sheets P, and cleaning devices 226*a* to 226*d* for removing the remaining toner on the photoreceptor drums, are disposed in this order along a rotating direction of the photoreceptor drums.

The laser writing unit 227 writes electrostatic latent images on the photoreceptor drum 222 based on image information. The laser writing unit 227 is composed of a first laser writing unit 227*a* corresponding to a black component, a second laser writing unit 227*b* corresponding to a cyan component, a third laser writing unit 227*c* corresponding to a magenta component, and a fourth laser writing unit 227*d* corresponding to a yellow component.

The laser writing units 227*a* to 227*d* are provided above each of the photoreceptor drums 222*a* to 222*d*, and are substantially identical to one another in construction. Each of the laser writing units 227*a* to 227*d* is composed of semiconductor laser elements (not shown) for emitting dot light modulated according to image data, polygon mirrors (deflecting devices) 240*a* to 240*d* for changing a direction of a laser beam from the semiconductor laser element in a main scanning direction, fθ lenses 241*a* to 241*d*, mirrors 242*a* to 242*d*, and mirrors 243*a* to 243*d* for forming an image of a laser beam, which is deflected by the polygon mirrors 240*a* to 240*d*, on the surfaces of the photoreceptor drums 222*a* to 222*d*, and the like.

A pixel signal corresponding to a black component image of a color document image is inputted to the laser writing unit 227*a*, a pixel signal corresponding to a cyan component image of a color document image is inputted to the laser writing unit 227*b*, a pixel signal corresponding to a magenta component image of a color document image is inputted to the laser writing unit 227*c*, and a pixel signal corresponding to a yellow component image of a color document image is inputted to the laser writing unit 227*d*. Each of the laser writing units 227*a* to 227*d* emits a laser beam corresponding to an inputted pixel signal, and forms an image of the laser beam on the surfaces of the photoreceptor drums 222*a* to 222*d*. Then, the laser beam is scanned and exposed so that optical writing on the photoreceptor drums 222*a* to 222*d* is performed.

Thus, electrostatic latent images corresponding to image information of a document subjected to the color conversion are formed on each of the photoreceptor drums 222*a* to 222*d*. Moreover, the developing device 224*a* stores black toner, the developing device 224*b* stores cyan toner, the developing device 224*c* stores magenta toner, and the developing device 224*d* stores yellow toner, respectively, and the electrostatic latent images on the photoreceptor drums 222*a* to 222*d* are developed by the toners of each color. Thereby, the image information of the document subjected to the color conversion in the image forming portion 220 is reproduced as toner images of each color.

The sheet P is transported to each of the image forming stations 228*a* to 228*d* in order by the transfer sheet transport belt 230, and toner images developed on the photoreceptor drums 222*a* to 222*d* are transferred to the sheet P. That is, the toner images of each color are formed in each of the image forming stations 228*a* to 228*d*, and are superimposed one after another on the sheet P which is electrostatically absorbed and transported on the transfer sheet transport belt 230. When the image transfer by all of the image forming stations 228*a* to 228*d* is completed, the sheet P is released off the transfer sheet transport belt 230 and transported to the fixing device 229.

The fixing device 229 fixes a toner image transferred and formed on the sheet P onto the sheet P. The fixing device 229 is disposed in a downstream side of the transfer sheet transport belt mechanism 221 in the sheet transport path, and is provided with a pair of fixing rollers made of a heat roller 229*a* and a pressure roller 229*b*, a release member and the like. The sheet P is transported through a nip portion between the fixing rollers so that the toner image is formed on the sheet P, and released off the fixing rollers by the release member to be transported to a sheet discharge portion 240.

The sheet discharge portion 240 discharges the sheet P on which image formation is completed to outside of the digital color copying machine. The sheet discharge portion 240 is provided with a transport direction switching gate 241, a discharge roller 242, and a sheet discharge tray 243. In a one-side image formation mode, as described above, an image is formed on one side of the sheet P, and thereafter, the sheet P transported from the fixing device 229 is transported through the transport direction switching gate 241 and ejected by the discharge roller 242 on the sheet discharge tray 243, which is mounted on an outer wall of the digital color copying machine.

The transport direction switching gate 241 switches a transport path of the sheet P on which the toner image has been fixed, and selectively switches a track for discharging the sheet P to the sheet discharge tray 243 and a sheet re-feeding transport track for feeding the sheet P again to the image forming portion 220. In a double sided image formation mode, an image is formed on one side of the sheet P as described above, and thereafter a transport direction of the sheet P is switched by the transport direction switching gate 241 so that the sheet P can be transported to the image forming portion 220 again, and the sheet P is reversed by a switch-back transport path 250, to be supplied again to the image forming portion 220 through a sheet re-feeding transport path 260 which forms the sheet re-feeding transport route.

Here, in the above description, the laser writing unit 227 (227*a* to 227*d*) scans a laser beam for exposure so as to perform an optical writing on the photoreceptor drum 222 (222*a* to 222*d*). However, in the present apparatus, as a means for performing optical writing on the photoreceptor drum 222 (222*a* to 222*d*), a solid-state scanning writing optical system (LED head) which includes a light emitting diode array, an image-forming lens array and the like is also applicable, instead of the laser writing unit 227 (227*a* to 227*d*). The LED is smaller than the laser writing unit in size, and has no movable part which causes sound. Therefore, the LED head can be preferably used in an image forming apparatus such as a tandem system digital color copying machine, which requires a plurality of optical writing units.

A color sensor 15, which is a feature of the present invention, for detecting both of a reference toner image formed on the transfer transport belt 230 and a color of a sheet to be transported with one sensor is disposed above the transfer sheet transport path in front of the fixing device 229 in the present embodiment.

FIG. 2 is a block structural diagram of an image processing portion provided in the color digital copying machine, and the image processing portion is composed of an image data input portion 40, an image processing portion 41, an image data storage portion 42, an image data output portion 43, a central processing unit (CPU) 44, an image editing portion 45, and external interface portions 46 and 47.

The image data input portion 40 includes a three-line color CCD 40*a* capable of reading a monochrome document or a color document image and outputting line data decomposed into RGB color components, a shading correction circuit 40*b* for correcting a line image level of line data which is read in the color CCD 40*a*, a line adjusting portion 40*c* such as a line buffer for correcting a shift of image line data which is read in the three-line color CCD 40*a*, a sensor color correction portion 40*d* for correcting color data of line data of each color that is outputted from the three-line color CCD 40*a*, an MTF correction portion 40*e* for making correction to emphasize a change in a signal of each pixel, a γ correction portion 40*f* for making visibility correction by correcting contrast of an image.

The image processing portion 41 includes a monochrome data generating portion 41*a* (monochrome document) for generating monochrome data from an RGB signal which is a color image signal inputted from the image data input portion 40, an input processing portion 41*b* for converting an RGB signal into a YMC signal corresponding to each storage portion in a storage device and performing a clock converting operation, an area segmentation portion 41*c* for classifying input image data into characters, a halftone picture, and a photographic-picture, a black generating portion 41*d* for removing a base color in response to a YMC signal outputted from the input processing portion 41*b* so as to generate a black color, a color correction circuit 41*e* for adjusting each color of a color image signal based on each color conversion table, a zoom processing circuit 41*f* for zooming in and out image information which is inputted based on a set magnification, a spatial filter 41*g*, a halftone processing portion 41*h* for displaying gradation such as multilevel error dispersion and multilevel dither, and the like.

Image data of each color that is subjected to halftone processing is temporarily stored in an image data storage portion 42. A hard disc device 42*a* in the image data storage portion 42 includes four hard disks (rotatable memory mediums), which successively receive image data of 8 bits and 4 colors (32 bits) outputted from the image processing portion 41, convert 32-bit data into 8-bit image data of four colors while temporarily storing the data in the buffer, and store and control the image data for each color. Moreover, since each of the image forming stations is disposed at different positions, an RAM 42*b* as a delay buffer memory is caused to temporarily store image data of each color so as to transmit the image data to each of the laser scanner units at different timings, causing no displacement of color. The image data storage portion 42 further includes an image synthesizing memory for synthesizing a plurality of images, and the like.

The image data output portion 43 includes a laser control unit 43*a* for carrying out pulse width modulation based on image data of each color from the halftone processing portion 41*h*, and laser scanner units of each color 43*b*, 43*c*, 43*d*, and 43*e* for performing laser recording based on a pulse width modulated signal corresponding to an image signal of each color that is outputted from the laser control unit 43*a*.

The central processing unit (CPU) 44 controls the image data input portion 40, the image processing portion 41, the image data storage portion 42, the image data output portion 43, the image editing portion 45 (described later), and the external interface portions 46 and 47, based on a predetermined sequence. The image editing portion 45 performs a predetermined image edit on image data, which has been transmitted through the image data input portion 40, the image processing portion 41, or the interfaces (described later) and has been temporarily stored in the image data storage portion 42, and the edit of the image data is carried out by using an image synthesizing memory of the image data storage portion 42.

The interface 46 is communication interface means for receiving image data from an external image input processing apparatus (a communication portable terminal, a digital camera, a digital video camera and the like) which is provided in addition to the color digital copying machine. Note that, image data, which has been inputted from the interface 46, is also temporarily inputted to the image processing portion 41 for color space correction and the like, and the data level of the image data is converted to a data level applicable to the image editing portion 45 in the color digital copying machine, and then, the image data is stored and controlled in the hard disc device 42*a*.

The interface 47 is a printer interface for inputting image data generated by a personal computer, or a monochrome or color FAX interface for receiving image data from a FAX machine. Image data inputted from the interface 47 which is already composed of a CMYK signal, is temporarily subjected to the halftone processing portion 41*h*, and stored and controlled in the four hard disks of the hard disc device 42*a* in the image data storage portion 42.

Figure 3:
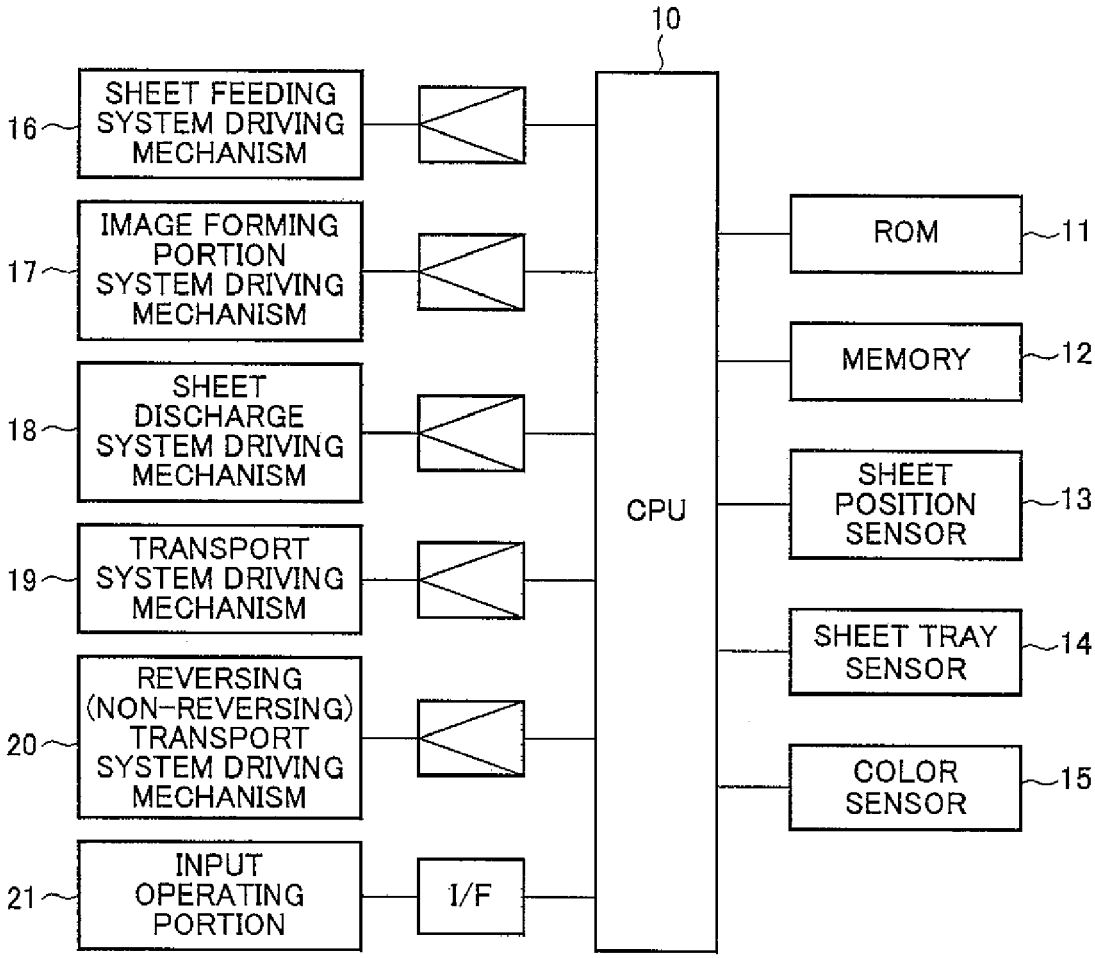
FIG. 3 is a block diagram showing the main structure of a control portion in the image forming apparatus according to the present invention.

FIG. 3 is a block diagram showing the main structure of a control portion in the image forming apparatus according to the present invention. While FIG. 1 shows the structure of the image forming apparatus, FIG. 3 shows a control system, and therefore components which are not shown in FIG. 1 are included in FIG. 3, on the other hand, some components shown in FIG. 1 are omitted in FIG. 3.

The control portion shown in FIG. 3 is mainly composed of a main CPU 10, and is provided with a ROM 11 which stores a control program for controlling a whole of the present apparatus and image forming operation, a memory 12 for storing an adjustment value or a set value of an automatic document feeder, and color information detected by a color sensor 15, a sensor 13 for detecting a sheet position in a sheet feed portion and each transport path, a sheet tray sensor 14 for detecting presence of a sheet in a sheet feed tray and change of a cassette, a color sensor 15 (described later) which is a feature portion of the present invention, a sheet feeding system driving mechanism 16 including a motor for driving a sheet feed roller and a resist roller, an image forming portion driving mechanism 17 including a motor for driving the drive roller in a transfer sheet transport belt mechanism 221 and a solenoid for driving a separation mechanism (not shown) for contacting and separating the transfer sheet transport belt 230 with and from the photoreceptor drum 222, a sheet discharge system driving mechanism 18 including a motor for driving the discharge roller 242 and the like, a transporting system driving mechanism 19 including a motor for driving a transport roller which transports sheets, and a solenoid for driving the transport direction switching gate 241 which switches transport directions, a reversing transport system driving mechanism 20 including a solenoid for switching the transport direction switching gate 251 in the switchback transport path 250 and a motor for driving a transport roller in a reversing (non-reversing) transport path (the sheet re-feeding transport path 260), and an input operating portion 21 which is composed of an operation panel provided with a display device and input key etc., and inputs setting of copy modes such as a color print mode and a variety of operations.

First Embodiment

Operation performed by the control portion (CPU) 10 based on a control program stored in the ROM 11 in an image forming apparatus in the first embodiment of the present invention will hereinafter be described.

When a document is set on a color copying apparatus and a user executes a print job with a color print mode in the input operating portion 21, then firstly, prior to printing, a reference toner image is formed on the transfer sheet transport belt 230 through the photoreceptor drum 222 and the reference toner image is detected by the color sensor 15, so that adjustment of developing conditions is carried out based on color information of the reference toner image. The reference toner image formed on the transfer sheet transport belt 230 passes below the color sensor 15, and thereafter cleaned by cleaning means (not shown).

Figure 4A:
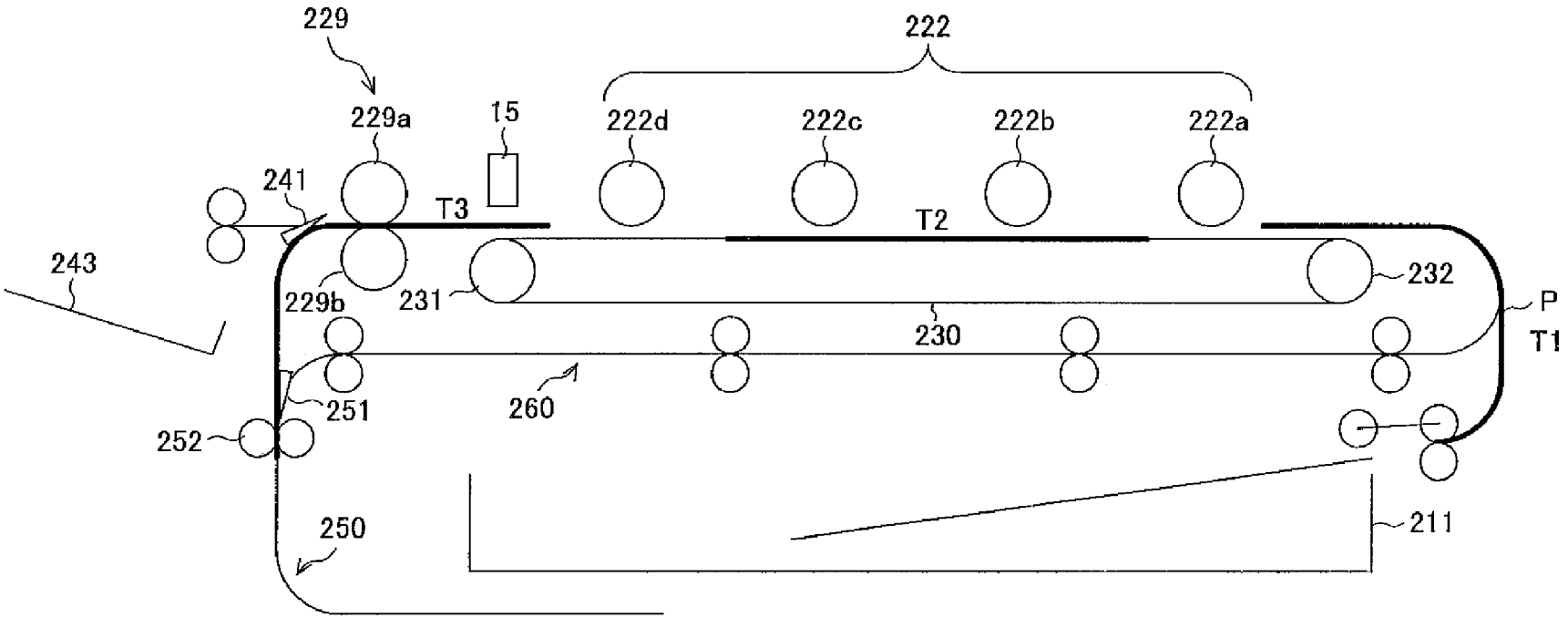
FIGS. 4A and 4B are diagrams illustrating operation of an image forming apparatus according to the first embodiment of the present invention.
Figure 4B:
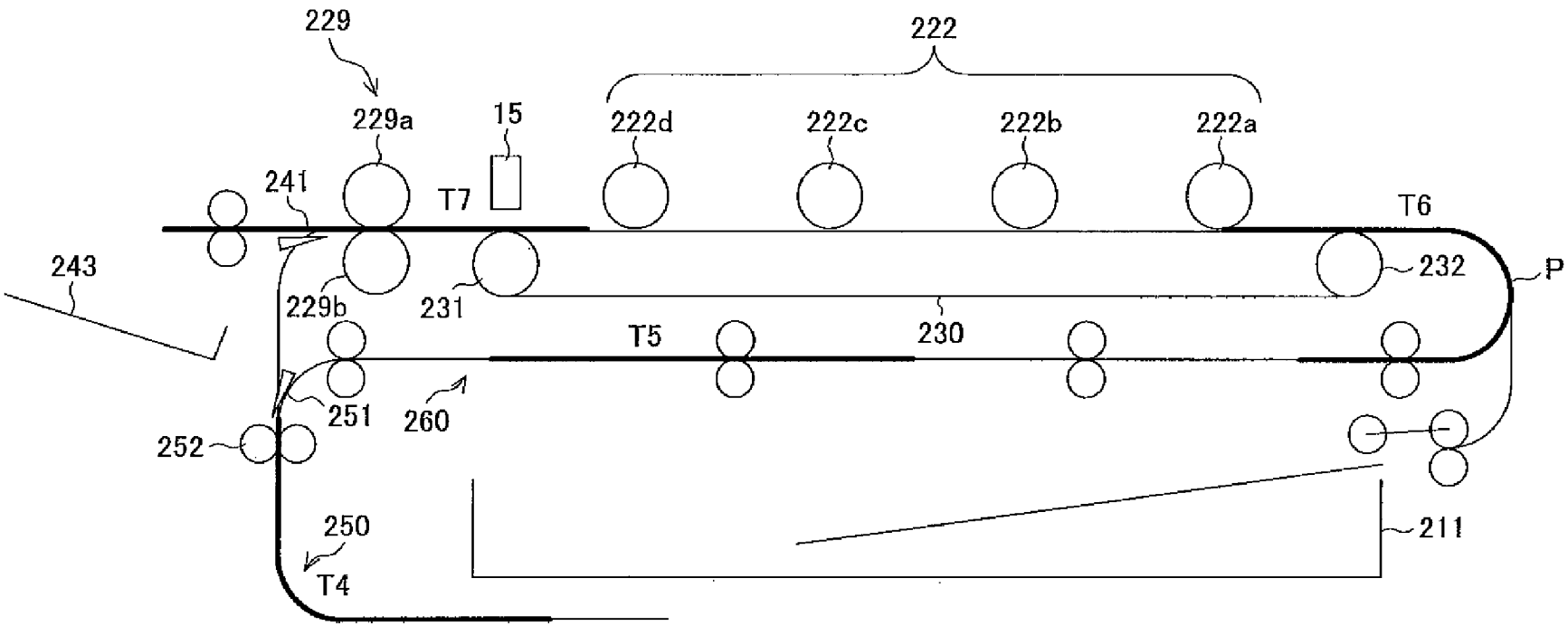

Now, referring to FIGS. 4A and 4B, image adjustment by color tone correction of input image data based on a sheet color, which is to be carried out after the above-mentioned image adjustment by adjusting the developing conditions, will be described. The present embodiment shows an example in a case where a reversing transport path (switchback transport path) is used. In FIG. 4A, when the above-mentioned image adjustment by adjusting the developing conditions is completed, the sheet P is fed from the sheet tray 211 (T1), transported in a state where the transfer sheet transport belt 230 is separated from the photoreceptor drum 222 (222*a*, 222*b*, 222*c*, and 222*d*) (T2), and a color of the sheet P is detected by the color sensor 15 which has detected the above-mentioned reference toner image (T3). Subsequently, in FIG. 4B, the sheet P the sheet color of which has been detected is guided to the switchback transport path 250 with a guide by transport direction switching gates 241 and 251 (T4), and thereafter the transport direction switching gate 251 is switched to a side of the sheet re-feeding transport path 260 and the sheet P in the switchback transport path 250 is fed to the sheet re-feeding transport path 260 by a reverse rotation of the transport roller 252 (T5), subsequently the sheet P is transported in a state of being reversed by the transfer sheet transport belt 230 which is being in contact with the photoreceptor drum 222 and a document image read by the image reading portion 110 is formed on the sheet P (T6). After image formation on the sheet P, the sheet P on which the image is fixed by the fixing device 229 is discharged to the sheet discharge tray 243 (T7).

The transfer rollers 225*a* to 225*d* are movable up and down by a contact/separation mechanism (not shown) and the transfer sheet transport belt 230 contacts with and separates from the photoreceptor drum 222 (222*a* to 222*d*) by moving the transfer rollers 225*a* to 225*d* up and down with a separation driving mechanism (not shown).

In the present embodiment, since the transfer sheet transport belt 230 separates from the photoreceptor drum 222 at the time of detecting a sheet color, the sheet P is not soiled.

When a reversing transport path is used, although an image is to be formed on the side different from the side which a sheet color has been detected, this method is applicable when both sides of a sheet have a same sheet color, and the present invention can be carried out using an existing reversing sheet transport path.

Second Embodiment

Figure 5A:
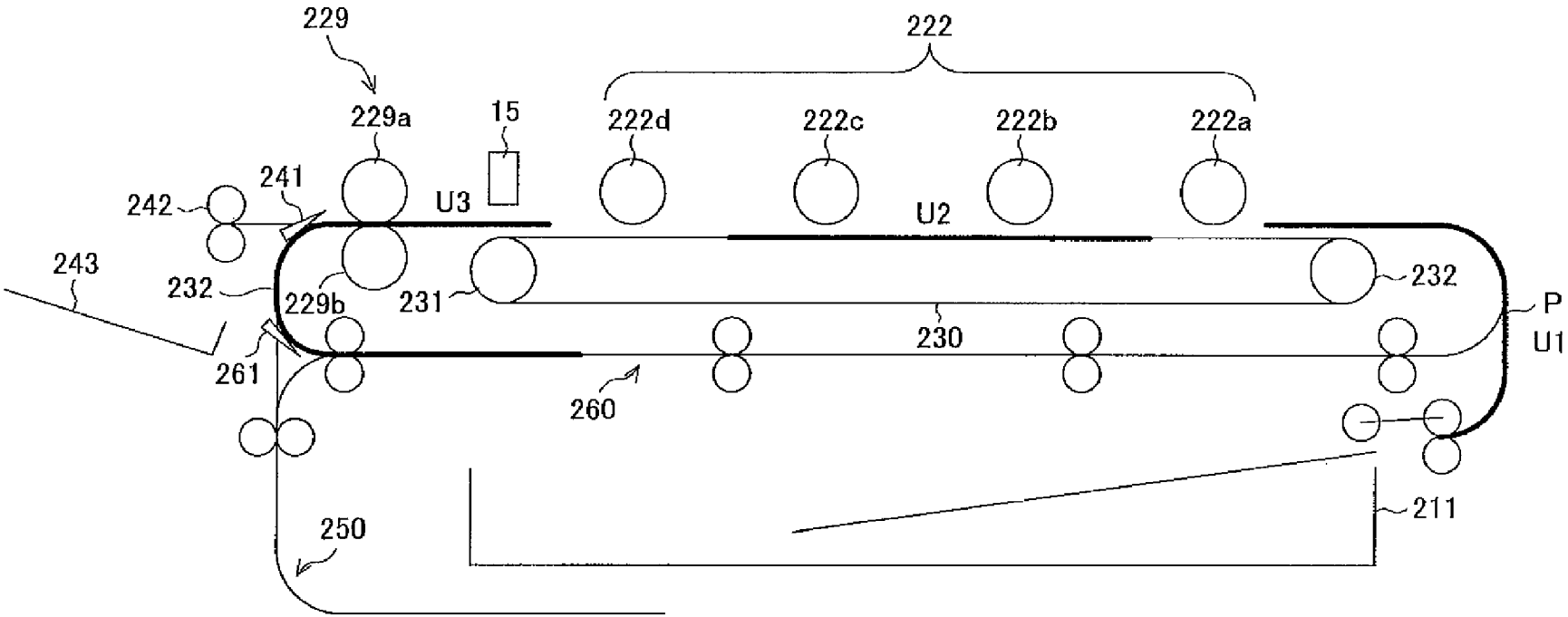
FIGS. 5A and 5B are diagrams illustrating operation of an image forming apparatus according to the second embodiment of the present invention.
Figure 5B:
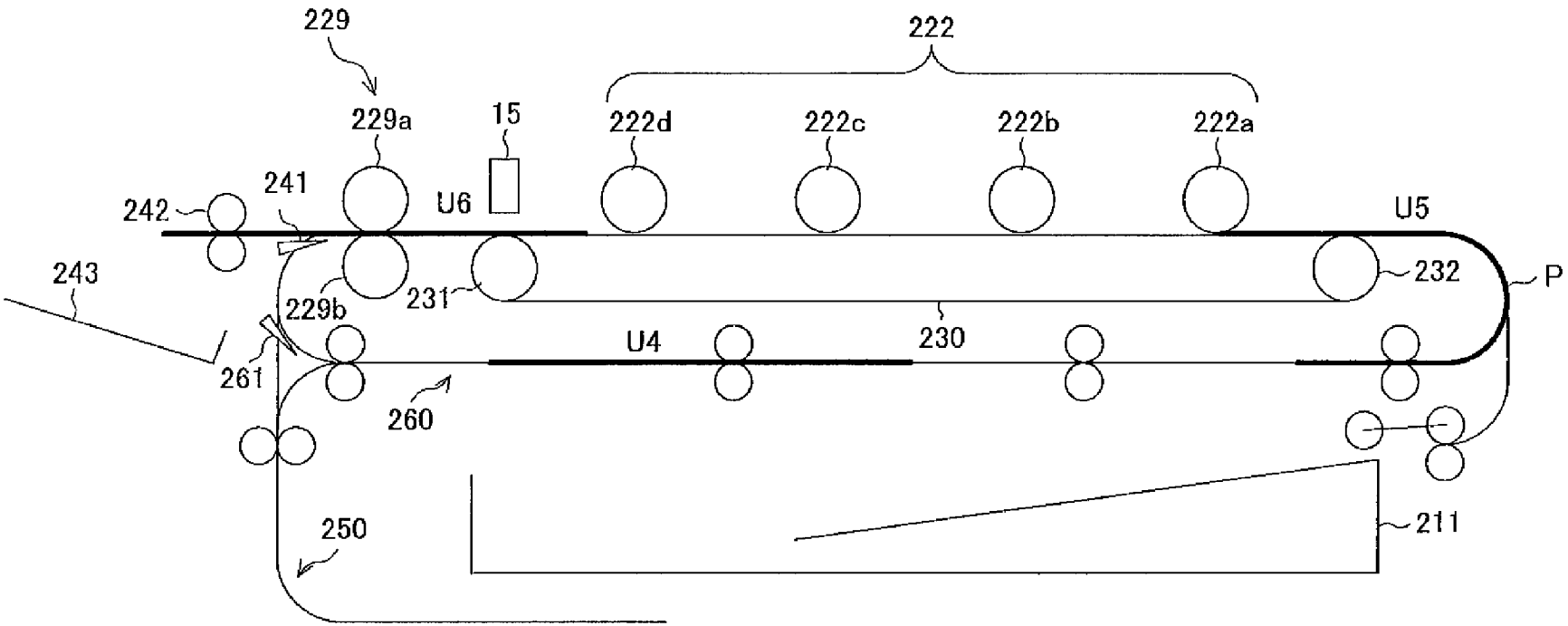

FIGS. 5A and 5B show an example in the case of an image forming apparatus provided with a non-reversing transport path, as the second embodiment of the present invention. In the case of the image forming apparatus provided with the non-reversing transport path, different from the case where a reversing transport path is used, an image is not formed on the side of the sheet different from the side which a sheet color has been detected and the image can be formed on the side which the sheet color has been detected, thus making it possible to carry out an accurate color correction even when both sides of the sheet have different sheet colors.

In FIG. 5A, when image adjustment by adjusting developing conditions is completed, similar to the case of the above-mentioned first embodiment, the sheet P is fed from the sheet tray 211 (U1), transported in a state where the transfer sheet transport belt 230 is separated from the photoreceptor drum 222 (222*a* to 222*d*) (U2), and a sheet color is detected by the color sensor 15 which has detected a reference toner image (U3). Subsequently, in FIG. 5B, the sheet P whose sheet color has been detected is guided to the sheet re-feeding transport path 260 with a guide by transport direction switching gates 241 and 261 to be fed again (U4), transported to the transfer sheet transport belt 230 which is being in contact with the photoreceptor drum 222 (222*a* to 222*d*), then an image to be printed on the sheet P is formed (US) After image formation on the sheet P, the sheet P on which the image is fixed by the fixing device 229 (229*a* and 229*b*) is discharged to the sheet discharge tray 243 (U6).

Next, the operation in the above-mentioned embodiment will be described using a flowchart.

Figure 6:
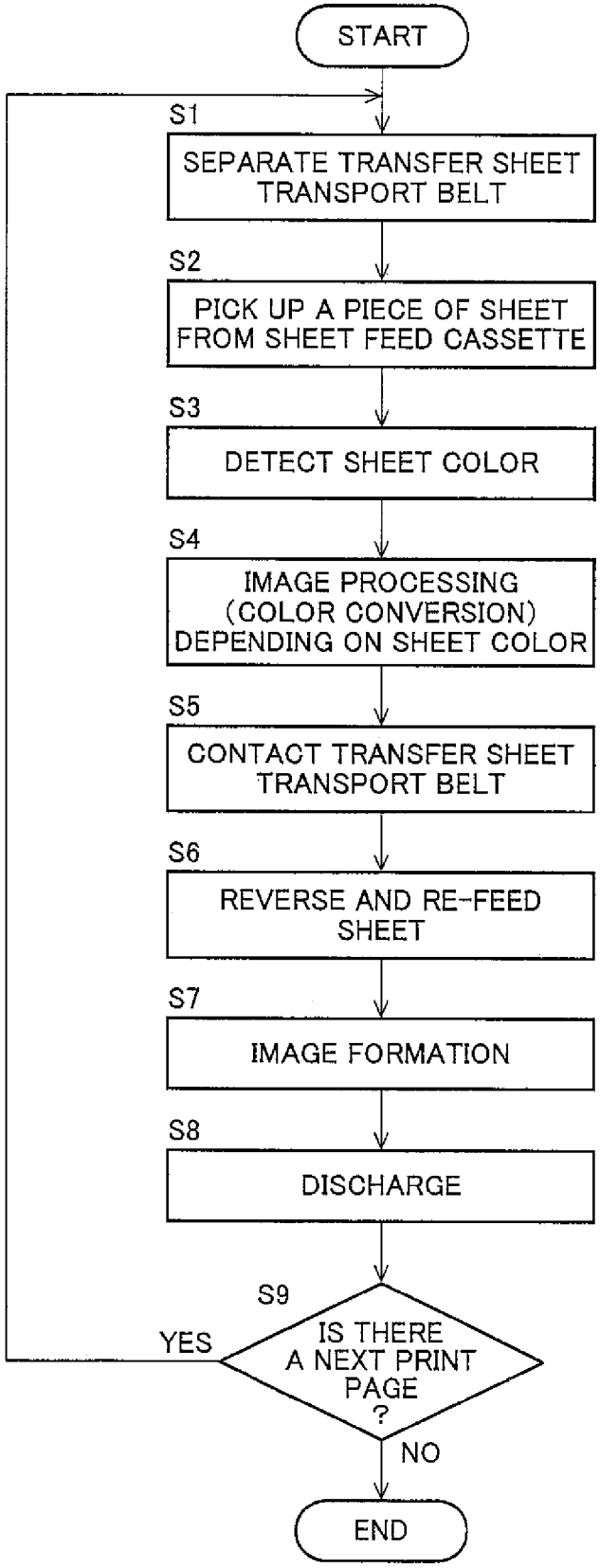
FIG. 6 is a flowchart of processing in a basic embodiment in the first and second embodiments of the present invention.

FIG. 6 is a flowchart of basic processing in image adjustment based on a sheet color, and the image adjustment starts when image adjustment by a reference toner image is completed, as described above.

In FIG. 6, firstly, the transfer sheet transport belt 230 is separated from the photoreceptor drum 222 (step S1). Then, a piece of sheet P is picked up from the sheet tray 211 (step S2). Subsequently, the sheet P is transported and a sheet color is detected by the color sensor 15 (step S3). Further, depending on the sheet color, image processing (color conversion) is applied to print data to reduce an influence of the sheet color (step S4).

Here, image processing of the present invention, which is carried out depending on the detected sheet color, will be described below. For example, when color component values of a sheet color, for example, a Y component value of $\alpha$, an M component value of $\beta$, and a C component value of $\gamma$ are detected by the color sensor, the image processing can be carried out so that the values of $\alpha$, $\beta$, and $\gamma$ are reduced from image data YMC values recorded in an image memory, respectively.

Specifically, for example, a following corresponding relation is satisfied between a value of yellow (X1) in print data and a value of a yellow component (X2) when the sheet color is detected by the color sensor; $\{X1=f(X2)\}$, where f denotes a function. For example, there is a following relation; $X1=\alpha \cdot X2$. In the relation of "$X1=\alpha \cdot X2$", when a value in detecting the sheet color (yellow component) is X2, "$\alpha \cdot X2$" is subtracted from the print data (yellow) to thereby reduce the yellow component of the sheet color from the print data, so that correction can be performed.

After going back to the flowchart shown in FIG. 6 again to perform the above-mentioned image processing, the transfer sheet transport belt 230 is made in contact with the photoreceptor drum 222 (222*a* to 222*d*) (step S5) and the sheet P is reversed by the switchback transport path 250 to be fed again (step S6). Subsequently, image formation is performed on the sheet P (step S7), and the sheet P is discharged to the sheet discharge tray 243 (step S8). Above steps are repeated as far as there is a next print page (step S9).

These are basic processing and may be carried out in the case of sheet feeding from a specific tray. For example, the processing may be carried out in the case of sheet feeding from a manual tray 214. Since various kinds of sheets are placed on the manual tray 214, the processing is always carried out at the time of sheet feeding so that color correction can be performed properly.

Third Embodiment

Figure 7A:
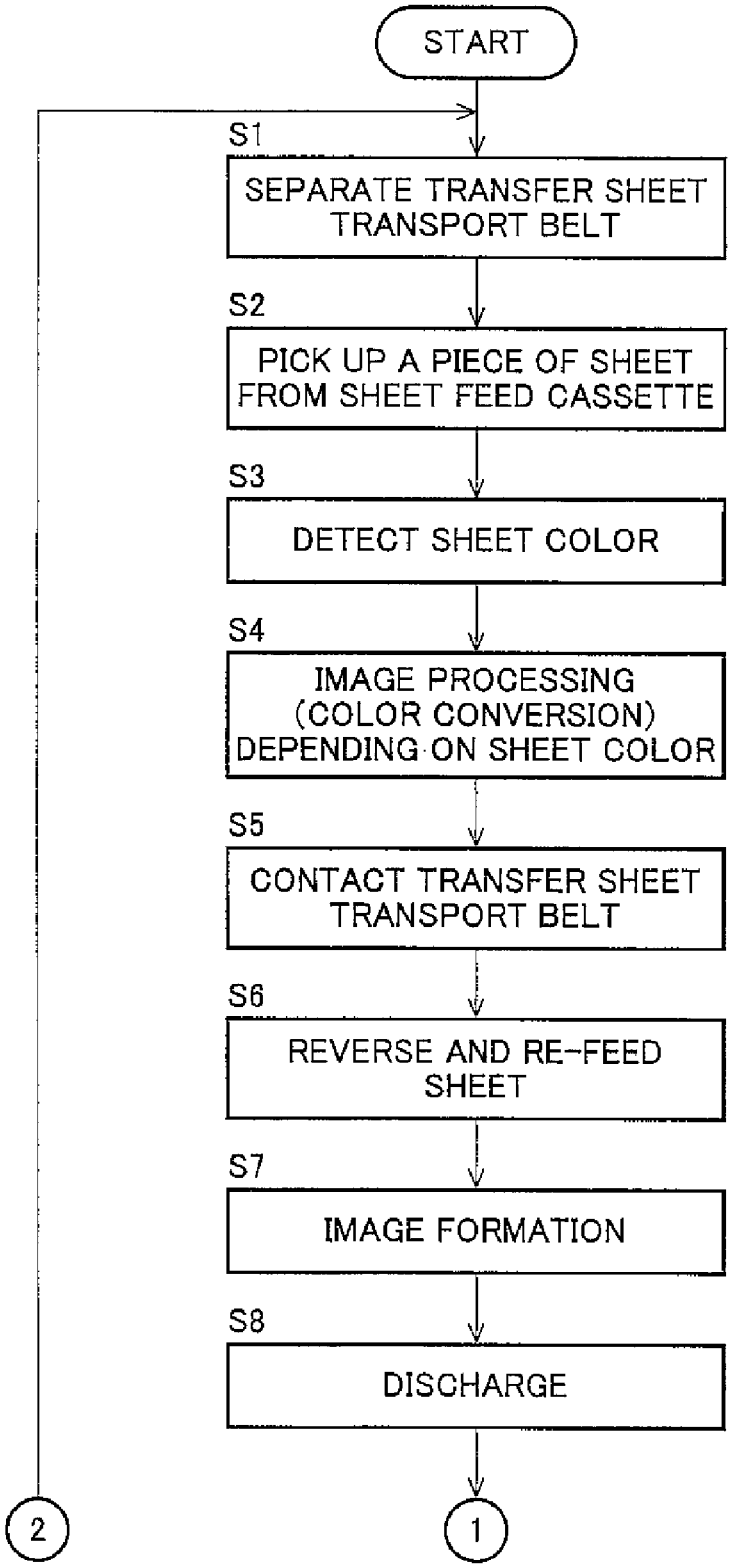
FIG. 7A is a flowchart of processing in the third embodiment of the present invention.
Figure 7B:
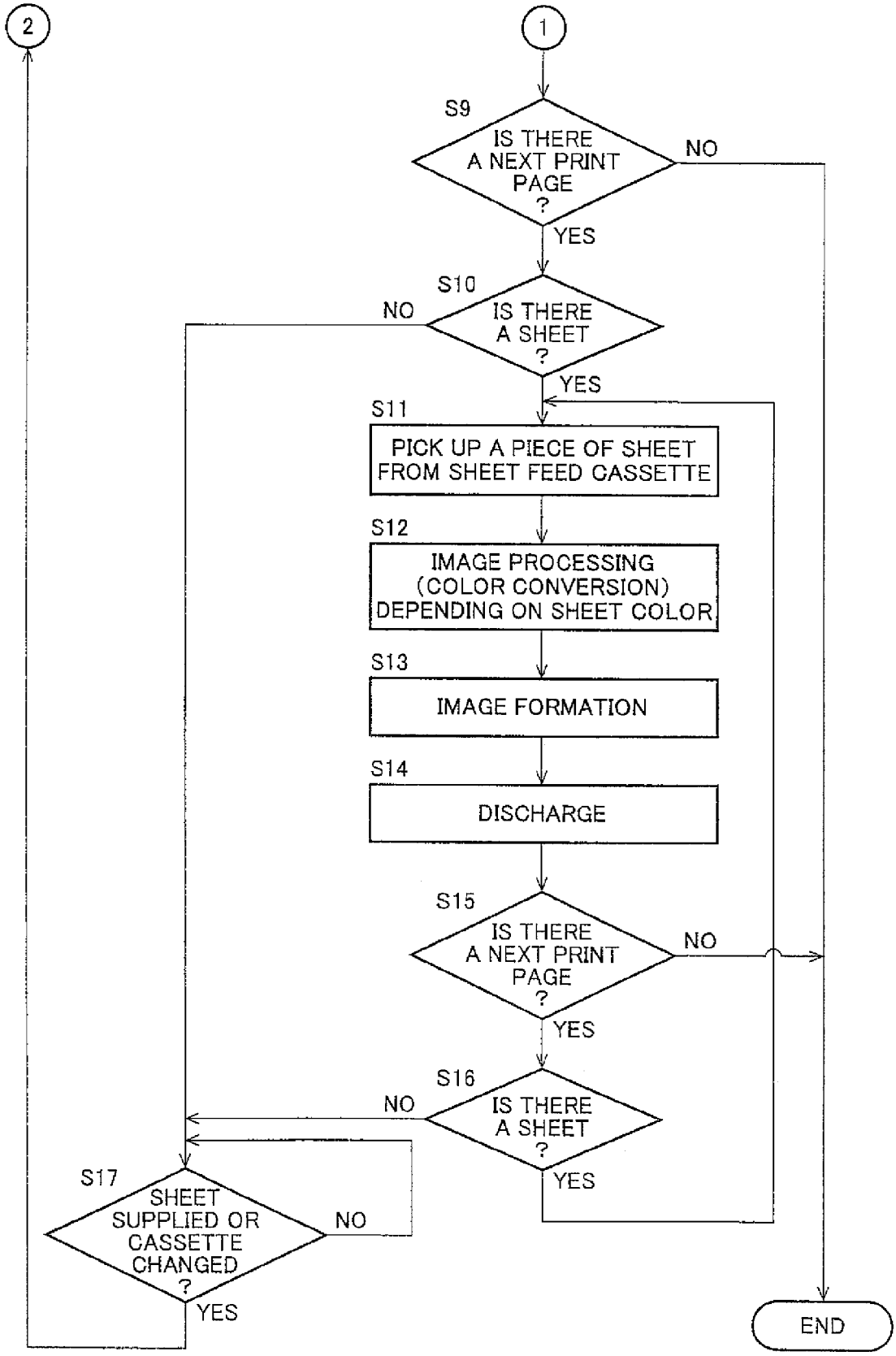
FIG. 7B is a flowchart subsequent to the flowchart shown in FIG. 7A.

FIGS. 7A and 7B are flowcharts of an embodiment in which a sheet color of only a first fed sheet is detected and the same image processing is performed based on the sheet color of the first sheet in subsequent image formation.

The present embodiment is suitable for a case where a type of sheets in the sheet tray is uniform and there is no need of detecting a sheet color for each sheet feeding.

Steps S1 to S9 are the same processing as that in the flowchart shown in FIG. 6, and description thereof will be omitted.

In the flowcharts, the image formation for the first sheet is performed at steps before step S9, subsequent image formation is performed at steps after step S9, and in image forming processing after step S9, the image processing is performed based on the sheet color of the first sheet.

At step S10, when it is detected that there is some sheets in the sheet tray 211 (step S10/Yes), the same processing as that of steps S2, S4, and S7 to S10 is performed (steps S11 to S16), and when it is detected that there is some sheets in the sheet tray 211 at step S16 (step S16/Yes), the processing goes back to step S11.

When there is no sheet, the processing proceeds to step S17 and waits until sheet supply is achieved. When sheet supply is achieved (step S17/Yes), the processing goes back to first step S1 and a sheet color is detected. Thus, the image processing can be performed appropriately even if the color of the supplied sheet is different from that of the previous sheet.

In the above description, although the processing is performed at the time of sheet supply, the same processing can be also performed in the case where sheet feeding is conducted from a different sheet tray by switching to the different sheet tray when there is no sheet.

Note that, when a non-reversing transport path is used, step S6 shown in FIGS. 6 and 7A can be realized by feeding sheets not using with the reversing transport path but using the non-reversing transport path.

Figure 8:
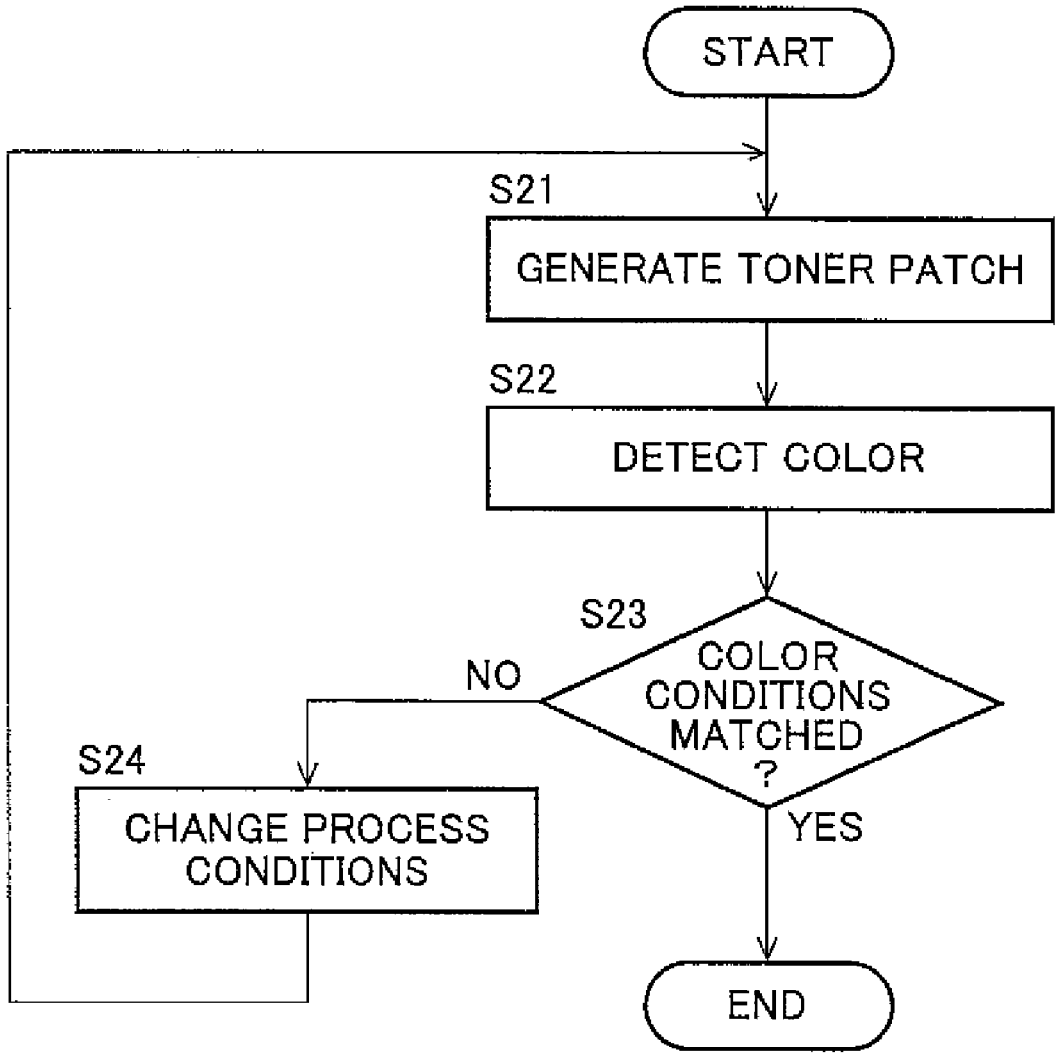
FIG. 8 is a flowchart of processing of changing development conditions in the image forming apparatus of the present invention.

FIG. 8 is a flowchart of processing of changing development conditions by a reference toner, which is performed before image adjustment based on a sheet color, in which when a user selects a color print mode and the processing starts. First, a reference toner image (toner patch) is generated on the transfer sheet transport belt 230 (step S21), and a color of the reference toner image is detected by the color sensor 15 (step S22). Whether or not the detected color of the reference toner image falls within a range of a predetermined reference value is determined (step S23) When it is out of the reference value, process conditions such as charging voltage and developing bias electrode are changed (step S24), and the processing is repeated until it falls within the range.

Fourth Embodiment

Figure 9:
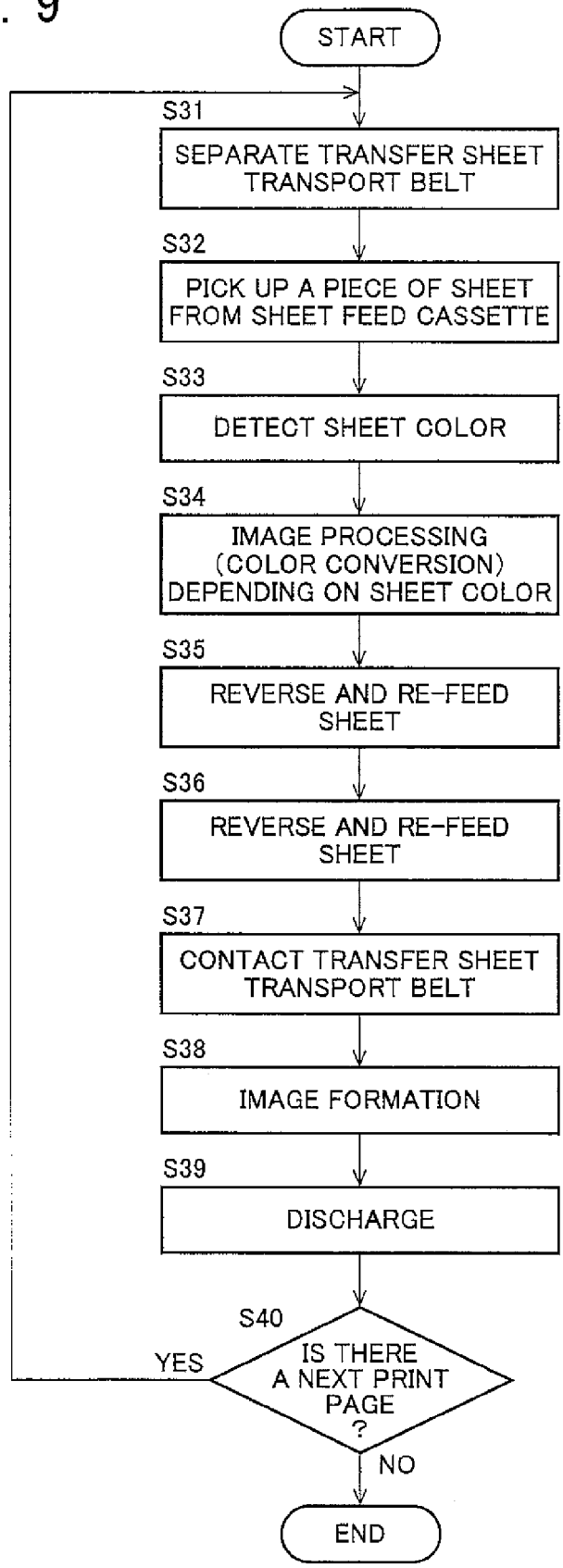
FIG. 9 is a flowchart of processing in the fourth embodiment of the present invention.

FIG. 9 is a processing flow in a fourth embodiment, in which when a reversing transport path is used, a sheet is reversed twice so that a side of a sheet which a sheet color has been detected can be the same side of the sheet on which a print image is to be formed.

Steps S31 to S34 are the same as steps S1 to S4 shown in FIG. 6. At step S35, the sheet is reversed so that the side of the sheet which the sheet color has been detected can be the printing side and fed again, and transported to the switchback transport path 250, and thereafter the sheet is reversed and fed again at step S36, and the transfer sheet transport belt 230 is made in contact with the photoreceptor drum (the image carrier) 222 to perform image formation of a print image on the side of the sheet which the sheet color has been detected (step S38), and the sheet is discharged (step S39). Above steps are repeated as far as there is a next print page (step S40).

Fifth Embodiment

Figure 10:
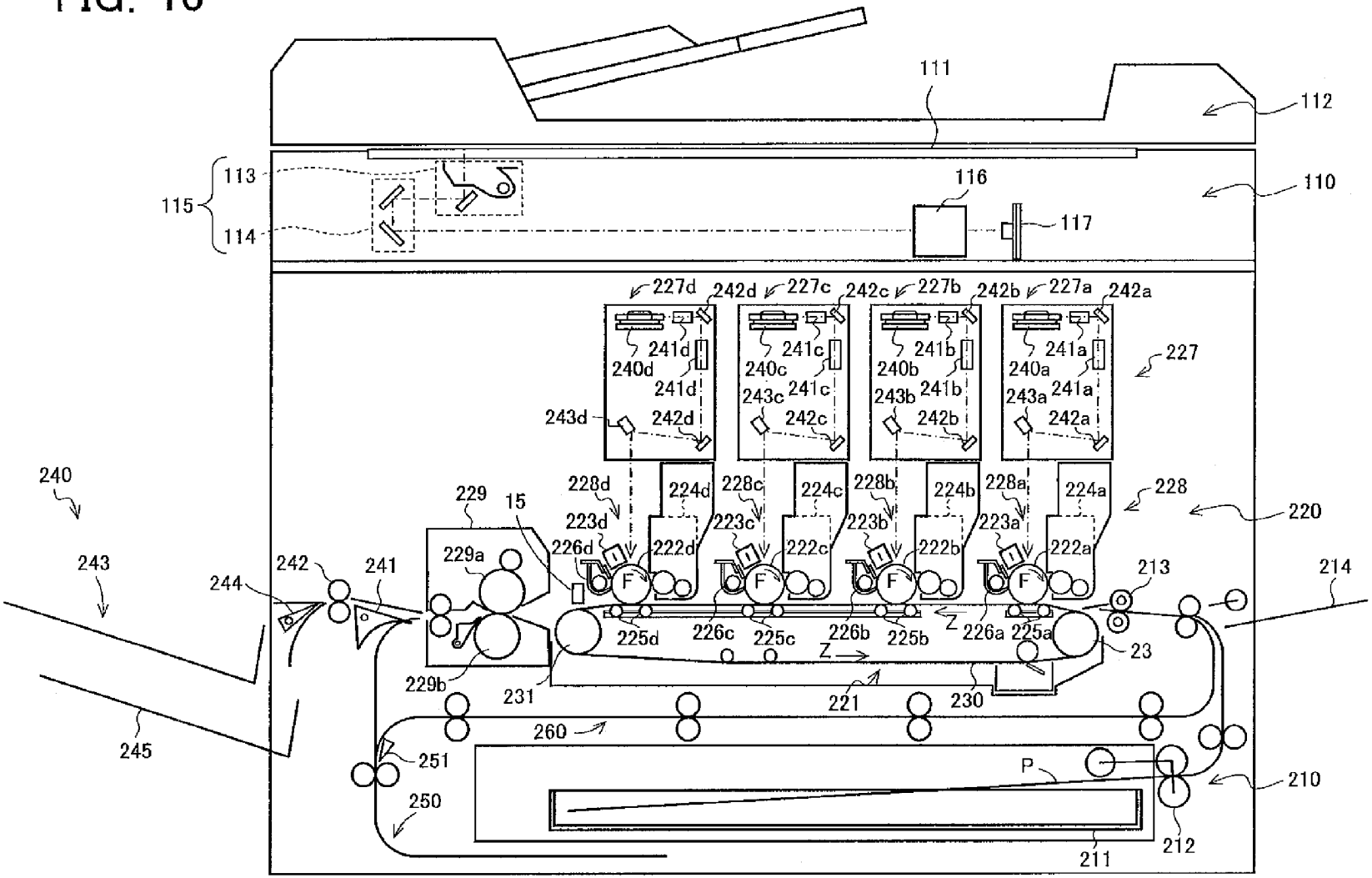
FIG. 10 is a sectional view schematically showing the structure of an image forming apparatus in the fifth embodiment of the present invention.

Now, a fifth embodiment of the present invention will be described referring to FIGS. 10 and 11. In the present embodiment, a reference toner image is formed on a sheet to perform image adjustment processing, and as shown in FIG. 10, a transport direction switching gate 244 and another sheet discharge tray 245 are provided between the sheet discharge roller 242 and the sheet discharge tray 243, and a sheet on which a reference toner image for image adjustment has been formed is discharged to the second sheet discharge tray 245 so as not to be mixed with a sheet on which a normal print has been performed.

Figure 11:
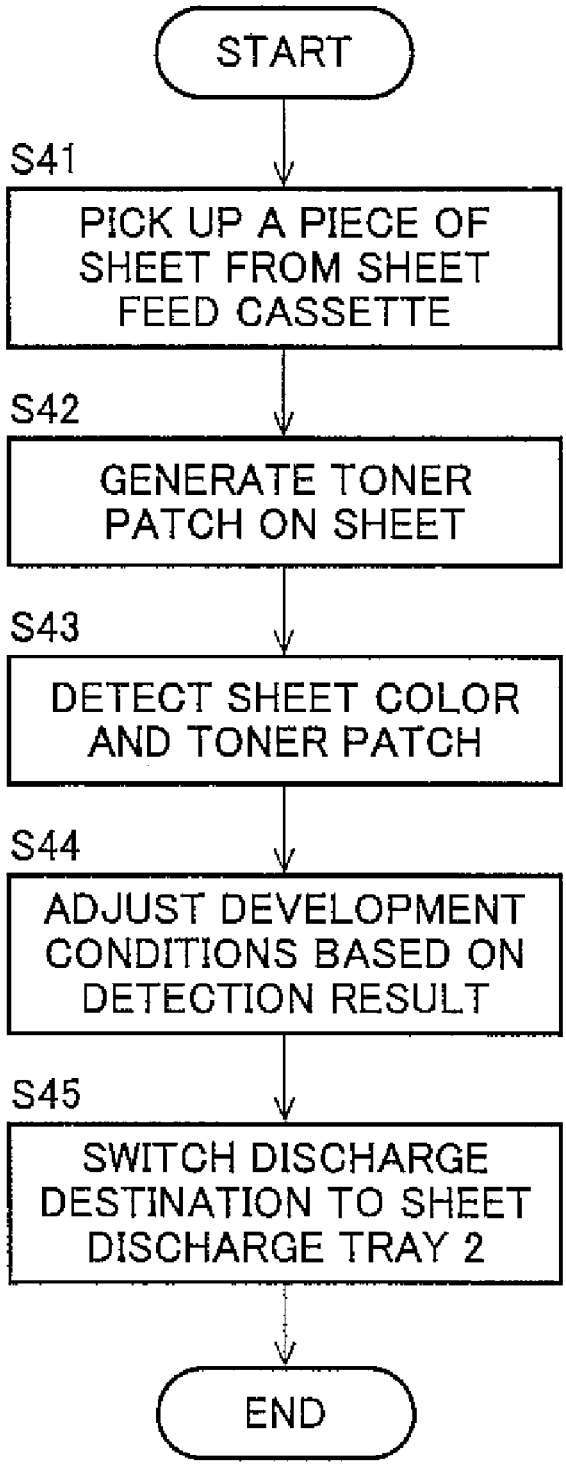
FIG. 11 is a flowchart of processing in the fifth embodiment of the present invention.

FIG. 11 is a processing flow of the present embodiment, in which when a user executes a print job in a color print mode from the input operating portion 21, the present processing starts prior to printing. First, a piece of sheet is picked up from a sheet feed cassette (step S41), and a toner patch as a reference toner image is formed on the sheet transported to the transfer sheet transport path (step S42). Subsequently, a sheet color and color information of the toner patch formed on the sheet are detected by the color sensor 15 (step S43), and development conditions are adjusted based on the detected sheet color and the color information of the toner patch (step S44). The transport direction switching gate 244 is switched to a side of the second sheet discharge tray 245 at a predetermined timing, and the sheet whose sheet color and toner patch have been detected is discharged into the second sheet discharge tray (step S45), followed by completing the processing for the image adjustment.

Sixth Embodiment

Next, an embodiment that a relation between a sheet feed source (sheet feed tray) and a type of a sheet is inputted from an operation panel so that image adjustment can be performed effectively, will be described.

On the input operating portion 21 (refer to FIG. 3) such as an operation panel, an input screen (not shown) for inputting sheet type information which is a relation between a sheet feed source and a type of a sheet is displayed, and the sheet type information inputted from the input screen is stored in the memory 12. For example, sheet type information of "1" is stored in association with the sheet tray 211, and sheet type information of "2" is stored in association with the manual tray 214.

Information showing types of sheets is stored in the sheet type information, for example, a name of a sheet such as "a recycled sheet" and "a color sheet Y" is stored.

Further, color correction information related to sheet type information is stored separately in the memory 12 so that same color correction is performed when the sheet type is set. For example, as a sheet type, color correction information of "$\alpha \cdot X2$" is recorded in association with "a recycled sheet". A value obtained by actually measuring a recycled sheet by the color sensor 15 is recorded and stored for X2.

By setting in this way, for example, when a user sets sheet type information of "a recycled sheet" for the manual tray and the manual tray is specified as a sheet feed source, an image forming apparatus reads color correction information corresponding to "a recycled sheet" and adopts it as a correction value. With such a structure, once a correction value is measured, color correction information thereof can be used thereafter, and color correction can be performed appropriately in printing from any sheet feed source.

According to the present invention, a color sensor for detecting a reference toner image on a transfer sheet carrier is also capable of detecting a sheet color and there is no need of disposing another color sensor for detecting the sheet color in a sheet transport path, and therefore, it is possible to prevent the number of components from being increased and reduce a size of an apparatus.

The invention claimed is:

1. An image forming apparatus including an image carrier on which a toner image depending on input image data is formed, a transfer sheet carrier for forming a transfer sheet transport path and transferring the toner image formed on the image carrier onto a sheet being transported, a color sensor disposed in a vicinity of the transfer sheet transport path, a control portion for controlling an image forming operation, and an image adjustment function which performs an image adjustment using a reference toner image prior to printing when a color print mode is selected, wherein, a separation driving mechanism for separating the transfer sheet carrier from the image carrier and then contacting them and a sheet re-feeding transport path for feeding the sheet which has passed through the transfer sheet transport path again to the transfer sheet transport path are further included, and the control portion performs a series of control at the time of the image adjustment, to form the reference toner image on a surface of the transfer sheet carrier, to detect the reference toner image by the color sensor, to adjust developing conditions based on color information of the detected reference toner image, then, to transport the sheet on the transfer sheet transport path in a state where the transfer sheet carrier is separated from the image carrier by the separation driving mechanism, to detect colors of the sheet by the color sensor, and to correct a color tone of the input image data based on the detected color of the sheet.

2. The image forming apparatus as defined in claim 1, wherein the sheet re-feeding transport path is the path reversing the side of the sheet.

3. An image forming apparatus including an image carrier on which a toner image depending on input image data is formed, a transfer sheet carrier for forming a transfer sheet transport path and transferring the toner image formed on the image carrier onto a sheer being transported, a color sensor disposed in a vicinity of the transfer sheet transport path, a control portion for controlling an image forming operation, and an image adjustment function which performs an image adjustment using a reference toner image prior to printing when a color print mode is selected, wherein, a separation driving mechanism for separating the transfer carrier from the image carrier and then contacting them and a sheet re-feeding transport path for feeding the sheet which has passed through the transfer sheet transport path again to the transfer sheet transport path are further included, and the control portion performs a series of control at the time of the image adjustment, to form the reference toner image on a surface of the transfer sheet carrier, to detect the reference toner image by the color sensor, to adjust developing conditions based on color information of the detected reference toner image, then, to transport the sheet on the transfer sheet transport path in a state where the transfer sheet carrier is separated from the image carrier by the separation driving mechanism, to detect colors of the sheet by the color sensor, and to correct a color tone of the input image data based on the detected color of the sheet, and the sheet re-feeding transport path is the path reversing the side of the sheet, and the control portion controls to pass the sheet transported at the time of the image adjustment through the reversing transport path twice in a state where the transfer sheet transport path is separated from the image carrier, and to transfer the toner image on the same surface as that of the sheet color has been detected.

4. An image forming apparatus including an image carrier on which a toner image depending on input image data is formed, a transfer sheet carrier for forming a transfer sheet transport path and transferring the toner image formed on the image carrier onto a sheet being transported, a color sensor disposed in a vicinity of the transfer sheet transport path, a control portion for controlling an image forming operation, and a function which performs an image adjustment using a reference toner image prior to a start of printing when a color print mode is selected, wherein the control portion controls formation of the reference toner image on the sheet transported to the transfer sheet transport path, detection of a color of the sheet and detection of the color of the reference toner image by the color sensor, and adjustment of developing conditions based on the detected color of the sheet and the detected color information of the reference toner image at the time of the image adjustment.

5. The image forming apparatus as defined in claim 4, wherein the control portion controls to discharge the sheet on which the reference toner image has been formed at the time of the image adjustment into a sheet discharge tray different from a sheet discharge tray generally used in printing.

6. The image forming apparatus as defined in claim 1, wherein the image adjustment is carried out at the time of the first sheet feeding after a sheet cassette has been changed.

7. The image forming apparatus as defined in claim 1, wherein the image adjustment is carried out at the time of the first sheet feeding after a sheet supplying has been performed.

8. The image forming apparatus as defined in claim 1, wherein when a sheet is fed from a specific sheet tray, the image adjustment is carried out for each sheet feeding.

9. The image forming apparatus as defined in claim 1 further including an operation input portion and a storage device for storing a variety of information such as color correction information based on sheet color information detected by the color sensor, wherein when sheet type information indicating a relationship between a sheet feed source of a sheet and a type of the sheet is inputted from the operation input portion, the sheet type information is stored in the storage device, and the control portion carries out the image adjustment based on the sheet type information and the color correction information which are stored in the storage portion.

10. The image forming apparatus as defined in claim 4, wherein the image adjustment is carried out at the time of the first sheet feeding after a sheet cassette has been changed.

11. The image forming apparatus as defined in claim 4, wherein the image adjustment is carried out at the time of the first sheet feeding after a sheet supplying has been performed.

12. The image forming apparatus as defined in claim 4, wherein when a sheet is fed from a specific sheet tray, the image adjustment is carried out for each sheet feeding.

13. The image forming apparatus as defined in claim 4 further including an operation input portion and a storage device for storing a variety of information such as color correction information based on sheet color information detected by the color sensor, wherein when sheet type information indicating a relationship between a sheet feed source of a sheet and a type of the sheet is inputted from the operation input portion, the sheet type information is stored in the storage device, and the control portion carries out the image adjustment based on the sheet type information and the color correction information which are stored in the storage portion.

* * * * *